US009609704B2

(12) United States Patent
Zotter

(10) Patent No.: US 9,609,704 B2
(45) Date of Patent: Mar. 28, 2017

(54) LOAD CONTROL DEVICE HAVING STUCK RELAY DETECTION

(71) Applicant: Lutron Electronics Co., Inc., Coopersburg, PA (US)

(72) Inventor: William Zotter, Coopersburg, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 0 days.

(21) Appl. No.: 15/087,838

(22) Filed: Mar. 31, 2016

(65) Prior Publication Data

US 2016/0295652 A1 Oct. 6, 2016

Related U.S. Application Data

(60) Provisional application No. 62/140,838, filed on Mar. 31, 2015.

(51) Int. Cl.
*H05B 33/08* (2006.01)
*H01H 47/00* (2006.01)

(52) U.S. Cl.
CPC ..... *H05B 33/0815* (2013.01); *H01H 47/002* (2013.01); *H01H 2047/003* (2013.01)

(58) Field of Classification Search
CPC .. G05D 1/0219; G05D 1/0225; G05D 1/0227; G05D 1/0272; G05D 2201/0203; H02H 3/006; H02H 3/44; H02H 7/0851; H02H 7/0854; H02H 7/222; H05B 37/0227; H05B 37/0209; H05B 41/16; H02S 40/44
See application file for complete search history.

(56) References Cited

U.S. PATENT DOCUMENTS

2014/0268474 A1 9/2014 Steiner et al.

FOREIGN PATENT DOCUMENTS

WO WO 2006/060264 A2 6/2006

*Primary Examiner* — Monica C King
(74) *Attorney, Agent, or Firm* — Condo Roccia Koptiw LLP

(57) ABSTRACT

A load control device (e.g., a switching device) for controlling power delivered from an AC power source to an electrical device (e.g., a lighting load) may be configured to detect that a relay is stuck closed and attempt to fix the relay. The relay of the load control device may be adapted to be coupled between the source and the electrical device to control the power delivered to the electrical device so as to generate a switched-hot voltage. The load control device may comprise a detect circuit configured to generate a detect signal indicating a magnitude of the switched-hot voltage, and a control circuit configured to monitor the detect signal. The control circuit may be configured to determine that the relay is stuck closed in response to the detect signal, and to control the relay in order to attempt to fix the relay by repeatedly closing and opening the relay.

31 Claims, 4 Drawing Sheets

LOAD CONTROL DEVICE HAVING STUCK RELAY DETECTION

CROSS REFERENCE TO RELATED APPLICATION

This application claims the benefit of Provisional U.S. Patent Application No. 62/140,838, filed Mar. 31, 2015, the disclosure of which is incorporated herein by reference in its entirety.

BACKGROUND

Load control devices, such as switches, for example, use mechanical switches, such as electrical relays, to switch alternating currents being supplied to an electrical load. These electrical relays may include at least two contacts (e.g., a fixed contact and a movable contact), and may be in an open state or a closed state. The lifetime of such electrical relays may be shortened by arcs or sparks caused as the contacts of the relay attempt to come into contact with one another (i.e., when the relay attempts to close).

Some electrical loads, such as drivers for light-emitting diode (LED) light sources, behave as capacitive loads. When an LED light source is switched on by the load control device, there is a large in-rush of current into the driver, which quickly subsides as the input capacitance of the driver charges up to line voltage. This temporary current surge can be problematic as the number of drivers controlled by an electrical relay increases. For example, in the case of a full 16-amp (e.g., steady-state) circuit of drivers, the in-rush current can approach 560 amps. Though short-lived (e.g., only a few line cycles or shorter), this level of surge can wreak havoc on the contacts of even a relatively large relay having a high current rating (e.g., 50 amps). The problem stems from the fact that each time a pair of contacts of the electrical relay close or snap together, there is a tendency for the contacts to bounce apart. When this bouncing occurs during a large current surge, the intervening gas or air ionizes and arcing occurs. The arcing has the effect of blasting away the conductive coatings on the relay contacts which eventually causes the relay to fail, either due to erosion of the contact material, or, more commonly, due to welding of the contacts in the closed position.

Some prior art switching circuits for drivers have required advanced components and structures (such as microcontrollers and multiple relays per driver circuit), and complex switching techniques. An example of such a switching circuit is described in greater detail in commonly-assigned U.S. Pat. No. 5,309,068, issued May 3, 1994, entitled TWO RELAY SWITCHING CIRCUIT FOR FLUORESCENT LIGHTING CONTROLLER, and U.S. Pat. No. 5,633,540, issued May 27, 1997, entitled SURGE-RESISTANT RELAY SWITCHING CIRCUIT, the entire disclosures of which are hereby incorporated by reference. Other prior art switching circuits seek to suppress arcs by controlling the relay actuation time such that the relay contact(s) close as nearly as possible to a zero cross of the alternating-current (AC) waveform. An example of such a switching circuit is described in greater detail in commonly-assigned U.S. Patent Application Publication No. 2014/0268474, published Sep. 18, 2014, entitled METHOD OF CLOSING A RELAY SWITCH AND APPARATUS THEREOF, the entire disclosure of which is hereby incorporated by reference. However, switching circuits utilizing these prior art techniques are still susceptible to having stuck relays due to welding of the contacts in the closed position.

SUMMARY

The present disclosure relates to a load control system for controlling the amount of power delivered to an electrical load, such as a lighting load, and more particularly, to a switching device for turning the electrical load on and off.

As described herein, a load control device for controlling power delivered from an AC power source to an electrical device may be configured to detect that a relay is stuck closed and attempt to fix (e.g., "un-stick") the relay. The load control system may include an electrical connection adapted to be electrically coupled to the AC power source, an electrical connection adapted to be electrically coupled to the electrical device, a relay electrically coupled between the two electrical connections and configured to control the power delivered from the AC power source to the electrical device so as to generate a switched-hot voltage at one of the electrical connections, a detect circuit electrically coupled to the second electrical connection and configured to generate a detect signal indicating a magnitude of the switched-hot voltage, and a control circuit. The control circuit may generate a drive signal for attempting to open and close the relay, monitor the detect signal, and determine whether the relay is open or closed based on the detect signal. The control circuit may perform a stuck closed procedure in response to determining that the relay is stuck closed. In the stuck closed procedure, the control circuit may attempt to close the relay, attempt to open the relay, monitor the detect signal, and determine whether the relay is stuck closed. In the stuck closed procedure, the load control system may wait a predetermined amount of time after attempting to open the relay and before monitoring the detect signal. The load control system may repeatedly perform the stuck closed procedure until the control circuit determines that the relay is open based on the detect signal or until the control circuit performs the stuck closed procedure a maximum number of times (e.g., variable $N_{MAX}$).

The load control system may include memory coupled to the control circuit. If the control circuit performs the stuck closed procedure the maximum number of times, the control circuit may wait a predetermined amount of time or mark the relay as stuck closed in the memory. If the control circuit waits the predetermined amount of time, the control circuit may repeatedly perform the stuck closed procedure until the control circuit determines that the relay is open based on the detect signal or until the control circuit performs the stuck closed procedure the maximum number of times. If the control circuit performs the stuck closed procedure the maximum number of times a second maximum number of times (e.g., $M_{MAX}$), the control circuit may mark the relay as stuck closed in the memory. After marking the relay as stuck closed in the memory, the control circuit may perform the stuck closed procedure for one or more additional times. The control circuit may receive a command to open the relay. In response to receiving the command to open the relay, the control circuit may control the drive signal to open the relay and to subsequently wait for a predetermined amount of time before monitoring the detect signal to determine if the relay is stuck closed.

The load control system may include an actuator configured to receive a user input. The control circuit may receive the command to open the relay via the actuator. The load control system may include a communication circuit configured to receive a digital message. The control circuit may receive the command to open the relay via the digital message. The load control system may include a visual indicator configured to be illuminated to provide feedback to a user. The control circuit may illuminate the visual indicator in response to determining that the relay is stuck closed. The control circuit may blink the visual indicator in response to determining that the relay is stuck closed.

The relay may include a latching relay. The control circuit may pulse a SET coil of the latching relay in response to determining that the relay is stuck closed. The relay may include a non-latching relay. The load control system may include a communication circuit configured to transmit a digital message in response to determining that the relay is stuck closed. The load control system may include a memory coupled to the control circuit. The control circuit may mark the relay as stuck closed in the memory in response to determining that the relay is stuck closed. The detect circuit may include a zero-cross detect circuit. The electrical device may include a lighting load.

DETAILED DESCRIPTION

Figure 1:
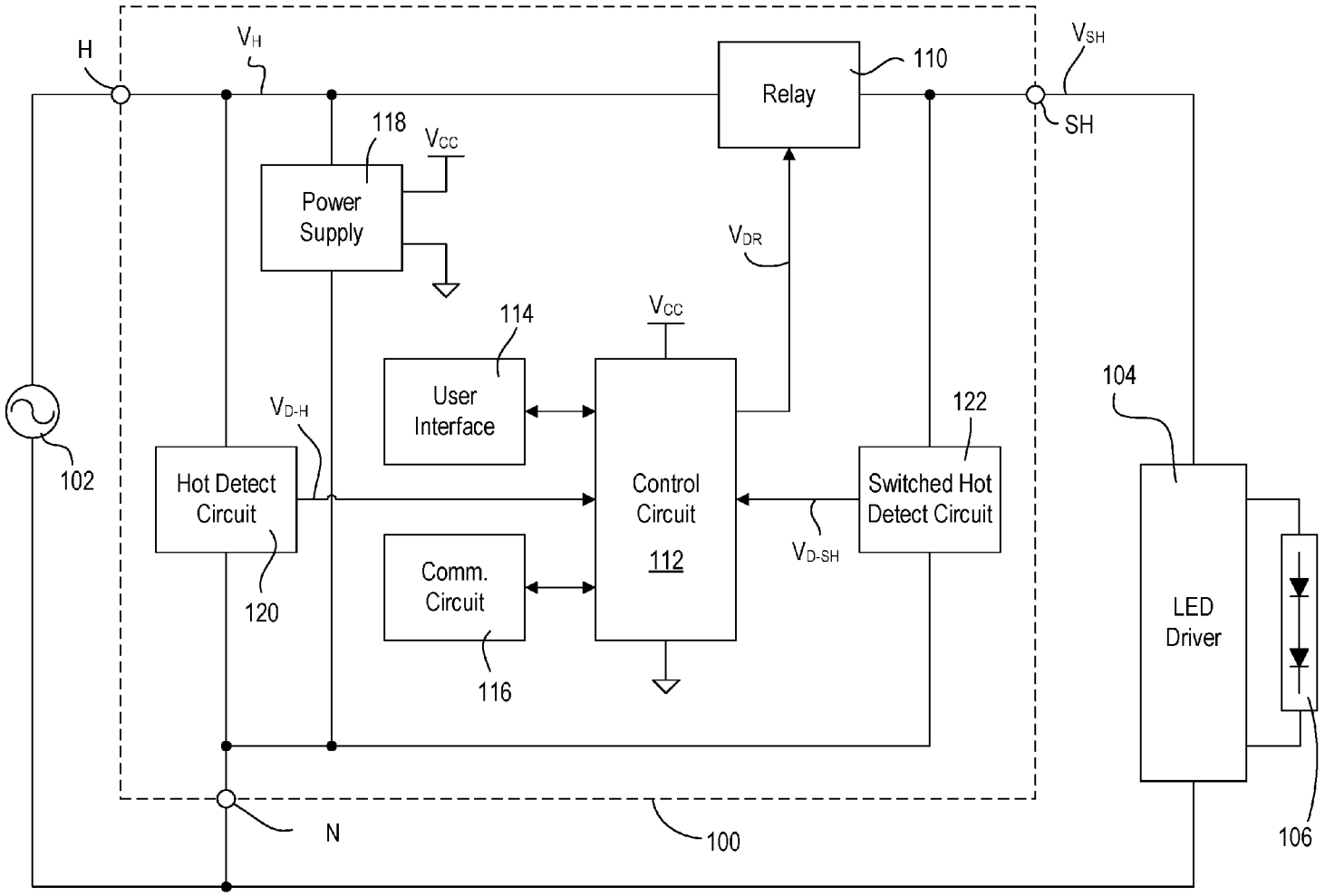
FIG. 1 is a block diagram of an example load control device.

FIG. 1 is a simplified block diagram of an example of a load control device 100 (e.g., a switching module). The load control device 100 is adapted to be electrically coupled in series between a power source (e.g., an alternating-current (AC) power source 102 or a direct-current (DC) power source) and an electrical device, e.g., an electrical load (e.g., such as a lighting load) and/or a load regulation device for an electrical load (e.g., such as, an LED driver 104 for an LED light source 106). The load control device 100 may comprise a hot terminal H adapted to be coupled to the hot side of an AC power source 102 for receiving a hot voltage $V_H$, a neutral terminal N adapted to be coupled to the neutral side of the AC power source, and a switched-hot terminal SH adapted to be coupled to the LED driver 104. The load control device 100 may be configured to control the power delivered to the LED driver 104 and thus the LED light source 106, e.g., to turn the LED light source on and off. The LED driver 104 may be configured to control the amount of power delivered to the LED light source 106, and thus the intensity of the LED light source. Examples of LED drivers are described in greater detail in commonly-assigned U.S. Pat. No. 8,492,987, issued Jul. 23, 2013, entitled LOAD CONTROL DEVICE FOR A LIGHT-EMITTING DIODE LIGHT SOURCE, and U.S. Patent Application Publication No. 2014/0009084, published Jan. 9, 2014, entitled FORWARD CONVERTER HAVING A PRIMARY-SIDE CURRENT SENSE CIRCUIT, the entire disclosures of which are hereby incorporated by reference. Alternatively, the electrical load could comprise an electronic ballast for driving a fluorescent lamp.

The load control device 100 may comprise a switching circuit, e.g., a relay 110, coupled in series electrical connection between the hot terminal H and the switched-hot terminal SH for controlling the power delivered to the LED driver 104 and the LED light source 106. The load control device 100 may comprise a control circuit 112 coupled to the relay 110 for rendering the relay conductive and non-conductive to control the power delivered to the LED driver 104 and the LED light source 106 (e.g., to turn the LED light source on and off). The control circuit 112 may be configured to generate a drive signal $V_{DR}$ for controlling the relay 110 to be conductive and non-conductive to generate a switched-hot voltage $V_{SH}$ at the switched hot terminal SH. The control circuit 112 may comprise any suitable controller or processing device, such as, for example, a microprocessor, a programmable logic device (PLD), a microcontroller, an application specific integrated circuit (ASIC), or a field-programmable gate array (FPGA). The control circuit 112 may also be coupled to a memory (not shown) for storage of operational characteristics of the load control device 100. The memory may be implemented as an external integrated circuit (IC) or as an internal circuit of the control circuit 112.

The relay may comprise a latching relay or a non-latching relay. For example, the relay may comprise a non-latching relay having a single SET coil, and the control circuit 112 may be configured to actively drive the drive signal $V_{DR}$ high to render the relay 110 conductive and to remove the drive signal to render the relay non-conductive. The relay 110 may comprise a latching relay having a SET coil for rendering the relay conductive and a RESET coil for rendering the relay non-conductive.

The load control device 100 may comprise a user interface 114 comprising, for example, one or more buttons (e.g., actuators) for receiving user inputs. The control circuit 112 may be configured to render the relay 110 conductive and non-conductive to turn the LED light source 106 on and off, respectively, in response to actuations of the buttons of the user interface, for example. The load control device 100 may comprise one or more indicators (e.g., visual indicators, audio indicators, etc.) for providing user feedback. For example, the control circuit 112 may be configured to illuminate visual indicators of the user interface 114 to provide, for example, a visual representation of the status of the LED driver 104 and/or the LED light source 106 (e.g., whether the LED light source is on or off, whether the load control device is stuck open/closed, etc.).

The load control device 100 may also comprise a communication circuit 116, e.g., a wireless communication circuit for transmitting and/or receiving wireless signals. For example, the communication circuit 116 may comprise a radio-frequency (RF) transceiver, an RF receiver, an RF transmitter, an infrared (IR) receiver, and/or other suitable wireless communication circuit. The load control device 100 may be configured to receive the wireless signals from input devices, such as, for example, a battery-powered remote control device and/or a wireless occupancy sensor. The control circuit 112 may be configured to control the LED light source 106 in response to the wireless signals received via the communication circuit 116. Examples of remote wireless occupancy and vacancy sensors are described in greater detail in commonly-assigned U.S. Pat. No. 7,940,167, issued May 10, 2011, entitled BATTERY-POWERED OCCUPANCY SENSOR; U.S. Pat. No. 8,009,042, issued Aug. 30, 2011, entitled RADIO-FREQUENCY LIGHTING CONTROL SYSTEM WITH OCCUPANCY SENSING; and U.S. Pat. No. 8,199,010, issued Jun. 12, 2012, entitled METHOD AND APPARATUS FOR CONFIGURING A WIRELESS SENSOR, the entire disclosures of which are hereby incorporated by reference. Alternatively, the communication circuit 116 could comprise a wired communication circuit operable to transmit and receive digital messages over a wired communication link, such as, for example, a serial communication link, an Ethernet communication link, a power-line carrier communication link, or other suitable digital communication link.

The load control device 100 may be responsive to other types of input devices, such as, for example, daylight sensors, radiometers, cloudy-day sensors, shadow sensors, window sensors, temperature sensors, humidity sensors, pressure sensors, smoke detectors, carbon monoxide detectors, air-quality sensors, motion sensors, security sensors, proximity sensors, fixture sensors, partition sensors, keypads, kinetic or solar-powered remote controls, key fobs, cell phones, smart phones, tablets, personal digital assistants, personal computers, laptops, timeclocks, audio-visual controls, safety devices (such as fire protection, water protection, and medical emergency devices), power monitoring devices (such as power meters, energy meters, utility submeters, utility rate meters), residential, commercial, or industrial controllers, interface devices with other control systems (such as security systems and emergency alert systems), or any combination of these input devices.

The load control device 100 may further comprise a power supply 118 for generating a DC supply voltage $V_{CC}$ for powering the control circuit 112, the wireless communication circuit 116, and/or other low-voltage circuitry of the load control device 100. The power supply 118 may, for example, be coupled between the hot terminal H and the neutral connection N.

The load control device 100 may comprise a hot detect circuit 120 and/or a switched-hot detect circuit 122. The hot detect circuit 120 may be coupled between the hot terminal H and the neutral terminal N. The hot detect circuit 120 may be configured to generate a hot detect signal $V_{D\text{-}H}$ that indicates the magnitude of the hot voltage $V_H$. The switched-hot detect circuit 122 may be coupled between the switched-hot terminal SH and the neutral terminal N. The switched-hot detect circuit 122 may be configured to generate a switched-hot detect signal $V_{D\text{-}SH}$ that indicates the magnitude of the switched-hot voltage $V_{SH}$. The hot detect circuit 120 and the switched-hot detect circuit 122 may each comprise, for example, a zero-cross detect circuit. For example, the hot detect circuit 120 may be configured to drive the hot detect signal $V_{D\text{-}H}$ high towards the supply voltage $V_{CC}$ when the magnitude of the hot voltage $V_H$ drops below a hot-detect threshold (e.g., approximately 30 volts), and the switched-hot detect circuit 122 may be configured to drive the switched-hot detect signal $V_{D\text{-}SH}$ high towards the supply voltage $V_{CC}$ when the magnitude of the switched-hot voltage $V_{SH}$ drops below a switched-hot-detect threshold (e.g., approximately 30 volts). The switched-hot voltage $V_{SH}$ may be measured across the LED driver 104 and/or the LED light source 106.

The control circuit 112 may be configured to receive the hot detect signal $V_{D\text{-}H}$ and/or the switched-hot detect signal $V_{D\text{-}SH}$. The control circuit 112 may be configured to determine the times of the zero-crossings of the hot voltage $V_H$ in response to the hot detect signal $V_{D\text{-}H}$ to determine when to open and close the relay 110. The control circuit 112 may be configured to determine a fault condition, for example, if the relay 110 did not successfully open or close, in response to the switched-hot detect signal $V_{D\text{-}SH}$. For example, the control circuit 112 may be configured to determine if the relay 110 opened successfully by monitoring the switched-hot detect signal $V_{D\text{-}SH}$ for a detect time period (e.g., approximately 15 milliseconds) after controlling drive signal $V_{DR}$ to render the relay non-conductive. If the control circuit 112 detects that the switched-hot voltage $V_{SH}$ is not present at the switched-hot terminal SH (e.g., the magnitude of the switched-hot voltage is approximately zero volts) at the end of the detect time period, the control circuit 112 may determine that the relay 110 opened properly and continue normal operation. However, if the switched-hot voltage is present at the switched-hot terminal SH, the control circuit 112 may determine that the relay 110 is stuck closed.

If the control circuit 112 determines that the relay 110 is stuck closed, the control circuit 112 may attempt to fix the stuck relay by performing a relay stuck closed procedure. The relay stuck closed procedure may comprise the control circuit 112 attempting to close the relay before subsequently attempting to open the relay, for example, with or without one or more delays. The process of attempting to close a relay that is determined to be stuck closed before subsequently attempting to open the relay may create a wiggle action between the relay contacts that may assist is freeing the contacts apart from one another, for example, by clearing the contacts of debris or breaking a small weld between the contacts. The control circuit may repeatedly perform the relay stuck closed process a maximum number of times, for example, before waiting a predetermined period of time or marking the relay as stuck (e.g., in memory).

For example, the control circuit 112 may repeatedly perform the relay stuck closed procedure (e.g., attempt to close and open the relay), for example, approximately five times while monitoring the switched-hot detect signal $V_{D\text{-}SH}$ to see if the relay 110 successfully opened. For example, the control circuit 112 may attempt to close and open a non-latching relay by alternately applying and removing a drive voltage to a SET coil of the non-latching relay, or may attempt to close and open a latching relay by alternately driving a SET coil and a RESET coil of the latching relay. If the relay 110 does not open after the maximum number of attempts (e.g., five attempts) to close and open the relay, the control circuit 112 may wait for a predetermined amount of time (e.g., two seconds) before once again attempting to close and open the relay five times. For example, the control circuit 112 may repeat the process of attempting five times to close and open the relay and then pausing a maximum number of times (e.g., three times), before finally marking the relay as stuck (e.g., in memory). If the relay 110 is marked as stuck, the control circuit 112 may be configured to blink a visual indicator of the user interface 114 and/or transmit a digital message indicating that the relay is stuck via the communication circuit 116. When the control circuit 112 receives another subsequent command to open the relay 110 (e.g., via the user interface 114 and/or the communication circuit 116), the control circuit may once again perform the relay stuck closed procedure one or more times.

If the control circuit 112 is driving a latching relay, the control circuit may be configured to pulse the drive voltage applied to the SET coil a maximum number of times (e.g., five times) to attempt to fix the stuck relay (e.g., rather than or in addition to repeatedly attempting to close and open the relay 110). For example, each time that the control circuit 112 attempts to close the relay 110, the control circuit 112 may pulse the drive voltage applied to the SET coil a maximum number of times. In addition, the control circuit 112 may be configured to pulse the RESET coil a predetermined number of time (e.g., five times) each time that the control circuit attempts to open the relay.

If the control circuit 112 determines that the relay 110 is stuck open, the control circuit 112 may attempt to fix the stuck relay by performing a relay stuck open procedure. The relay stuck open procedure may include the control circuit 112 attempting to open the relay before subsequently attempting to close the relay. The control circuit may repeatedly perform the relay stuck open procedure a maximum number of times, for example, before waiting a predetermined period of time or marking the relay as stuck (e.g., in memory). For example, the control circuit 112 may repeatedly perform the relay stuck open procedure (e.g., attempt to close and open the relay), for example, approximately five times while monitoring the switched-hot detect signal $V_{D\text{-}SH}$ to see if the relay 110 successfully closed. For example, the control circuit 112 may attempt to open and close a non-latching relay by alternately removing and applying a drive voltage to a SET coil of the non-latching relay, or may attempt to open and close a latching relay by alternately driving a RESET coil and a SET coil of the latching relay. If the relay 110 does not close after the maximum number of attempts (e.g., five attempts) to open and close the relay, the control circuit 112 may wait for a predetermined amount of time (e.g., two seconds) before once again attempting to open and close the relay five times. For example, the control circuit 112 may repeat the process of attempting five times to open and close the relay and then pausing a maximum number of times (e.g., three times), before finally marking the relay as stuck (e.g., in memory). If the relay 110 is marked as stuck, the control circuit 112 may be configured to blink a visual indicator of the user interface 114 and/or transmit a digital message indicating that the relay is stuck via the communication circuit 116. When the control circuit 112 receives another subsequent command to close the relay 110 (e.g., via the user interface 114 and/or the communication circuit 116), the control circuit may once again perform the relay stuck open procedure one or more times.

The load control device 100 be configured to control the power to other types of electrical loads, such as, for example, lighting loads (such as incandescent lamps, halogen lamps, electronic low-voltage lighting loads, and magnetic low-voltage lighting loads); dimming ballasts for driving gas-discharge lamps; table or floor lamps; screw-in luminaires including dimmer circuits and incandescent or halogen lamps; screw-in luminaires including ballasts and compact fluorescent lamps; screw-in luminaires including LED drivers and LED light sources; motor loads, such as ceiling fans and exhaust fans; motorized window treatments; projection screens; motorized interior or exterior shutters; heating and/or cooling systems; heating, ventilation, and air-conditioning (HVAC) systems; air conditioners; compressors; electric baseboard heater controllers; controllable dampers; variable air volume controllers; fresh air intake controllers; ventilation controllers; hydraulic valves for use in radiators and radiant heating system; humidity control units; humidifiers; dehumidifiers; water heaters; boiler controllers; pool pumps; refrigerators; freezers; appliances; televisions; computer monitors; printers; copiers; fax machines; video cameras; audio systems; amplifiers; speakers; overhead projectors; visual presenters; smart boards; coffee makers; toasters; elevators; power supplies; generators; electric chargers; electric vehicle chargers; medical devices, alternative energy controllers, and/or any combination of these electrical loads.

Figure 2B:
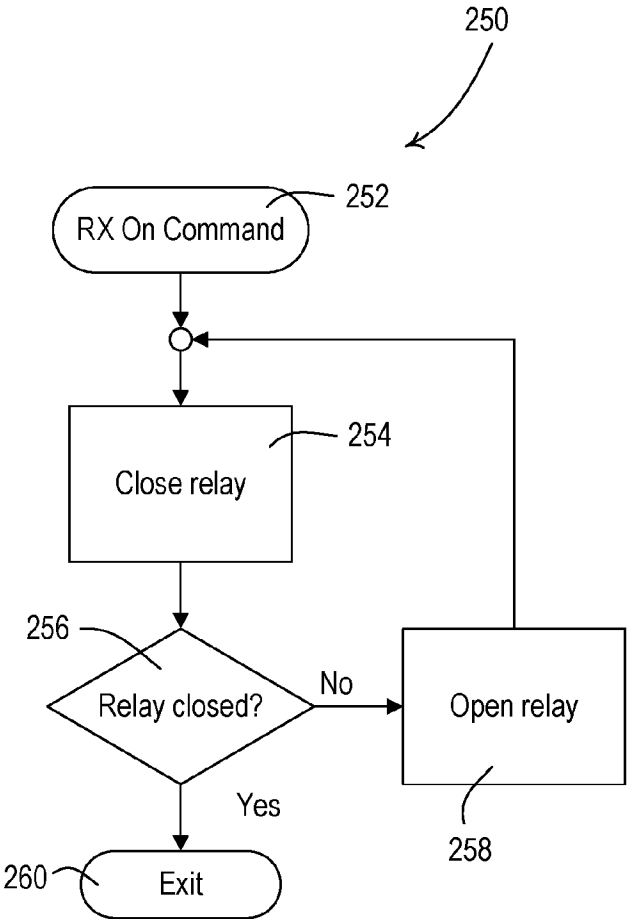
FIG. 2B is a flowchart of an example command procedure for closing a relay.
Figure 2A:
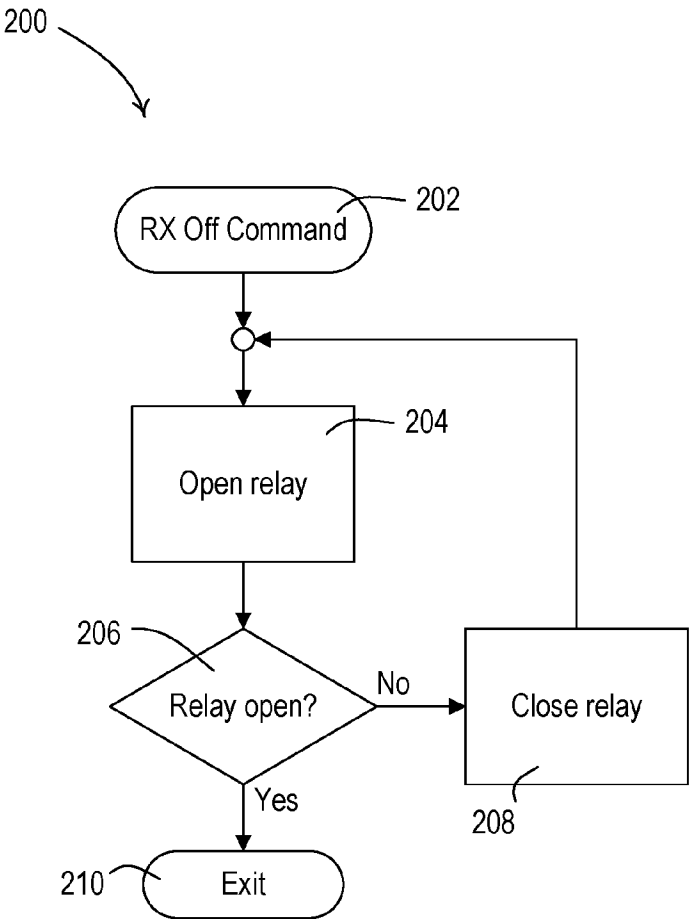
FIG. 2A is a flowchart of an example command procedure for opening a relay.

FIG. 2A is a flowchart of an example command procedure 200 for opening a relay. The command procedure 200 may be executed by a control circuit of a load control device (e.g., the control circuit 112 of the load control device 100) in response to receiving an off command at 202 (e.g., via the user interface 114 and/or the communication circuit 116). During the command procedure 200, the control circuit may determine if the relay has opened successfully and may attempt to open the relay if the relay is stuck closed. For example, the control circuit may receive the off command at 202 and attempt to open the relay at 204.

At 206, the control circuit may determine whether the relay is open. For example, the control circuit may monitor a switched-hot detect signal and/or a magnitude of switched-hot voltage at a switched-hot terminal for a detect time period after controlling a drive signal to render the relay non-conductive. If the relay detects that the switched-hot voltage is present at the switched-hot terminal at the end of the detect time period, the control circuit may determine that the relay is stuck closed. If the control circuit determines that the relay is stuck closed at 206, then the control circuit may attempt to close the relay at 208 and then attempt to re-open the relay at 204. After attempting to re-open the relay at 204, the control circuit may again determine whether the relay is open at 206. If the control circuit determines that the relay is open at 206, for example, by detecting that the switched-hot voltage is not present at the switched-hot terminal at the end of the detect time period, then the command procedure 200 ends.

FIG. 2B is a flowchart of an example command procedure 250 for closing a relay. The command procedure 250 may be executed by a control circuit of a load control device (e.g., the control circuit 112 of the load control device 100) in response to receiving an on command at 252 (e.g., via the user interface 114 and/or the communication circuit 116). During the command procedure 250, the control circuit may determine if the relay has closed successfully and may attempt to close the relay if the relay is stuck open. For example, the control circuit may receive the on command at 252 and attempt to close the relay at 254.

At 256, the control circuit may determine whether the relay is closed. For example, the control circuit may monitor a switched-hot detect signal and/or a magnitude of switched-hot voltage at a switched-hot terminal for a detect time period after controlling a drive signal to render the relay conductive. If the relay detects that the switched-hot voltage is not present at the switched-hot terminal at the end of the detect time period, the control circuit may determine that the relay is stuck open. If the control circuit determines that the relay is stuck open at 256, then the control circuit may attempt to open the relay at 258 and then attempt to re-close the relay at 254. After attempting to re-close the relay at 254, the control circuit may again determine whether the relay is closed at 256. If the control circuit determines that the relay is closed at 256, for example, by detecting that the switched-hot voltage is present at the switched-hot terminal at the end of the detect time period, then the command procedure 250 ends.

Figure 3A:
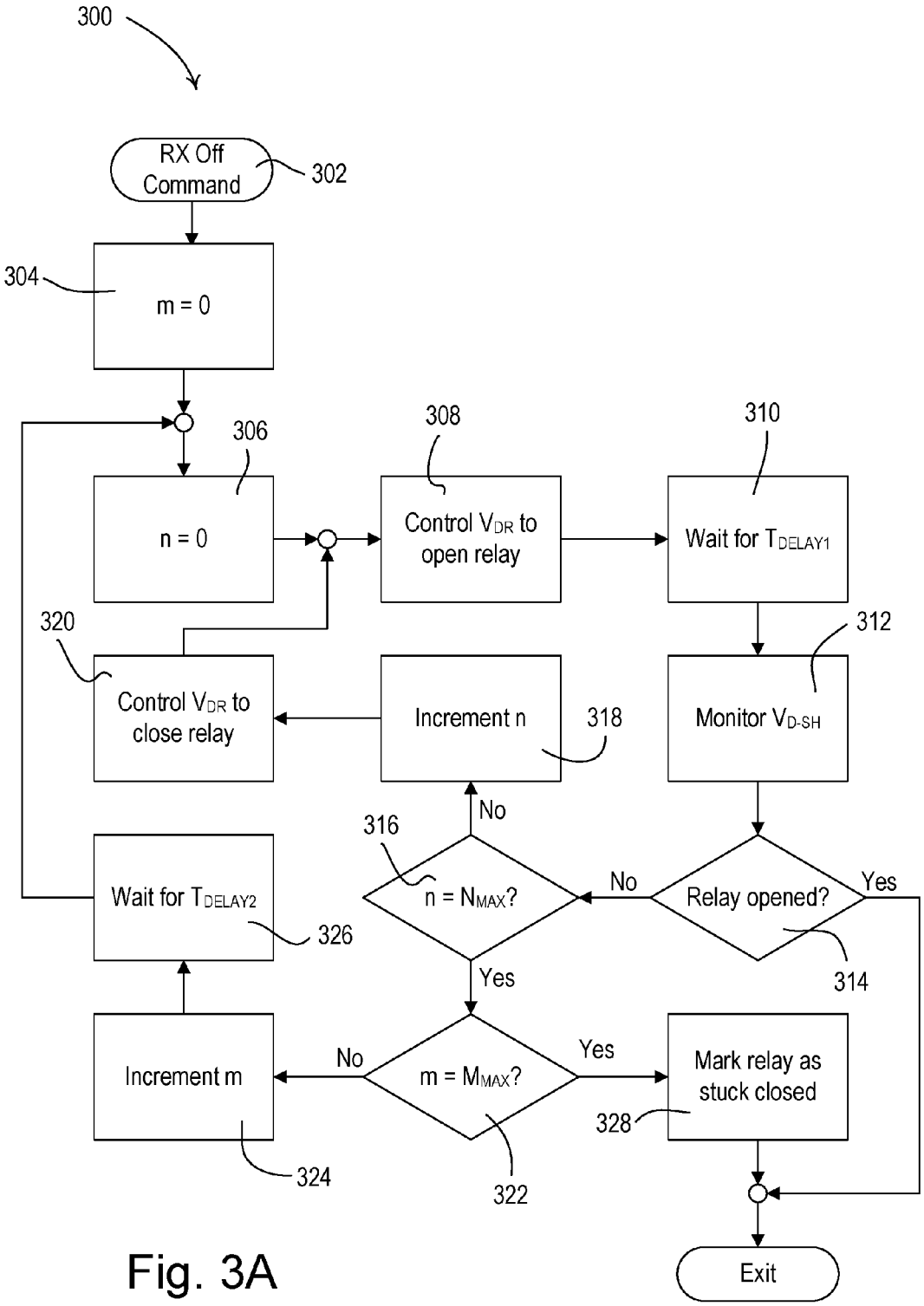
FIG. 3A is a flowchart of another example command procedure for opening a relay.

FIG. 3A is a flowchart of another example command procedure 300 for opening a relay. The command procedure 300 may be executed by a control circuit of a load control device (e.g., the control circuit 112 of the load control device 100) in response to receiving an off command at step 302 (e.g., via the user interface 114 and/or the communication circuit 116). During the command procedure 300, the control circuit may determine if the relay has opened successfully, and may attempt to close and then open the relay if the relay is determined to be stuck closed. The control circuit may use two variables m, n during the command procedure 300 to keep track of how many times the control circuit has tried opening and closing the switch (e.g., performed the relay stuck closed procedure) after determining that the relay is stuck closed.

The control circuit may receive an off command at 302. The control circuit may initialize the variable m to zero at 304 and initialize the variable n to zero at 306. The control circuit may then control the drive voltage $V_{DR}$ to open the relay at 308, for example, by ceasing to drive a SET coil of a non-latching relay or by pulsing a RESET coil of a latching relay. The control circuit may wait at 310 for a first delay time period $T_{DELAY1}$, which for example, may correspond to the total turn-off delay of the relay and electrical hardware driving the relay (e.g., approximately 15 milliseconds).

At 312, the control circuit may monitor (e.g., sample) a switched-hot detect signal (e.g., the switched-hot detect signal $V_{D\text{-}SH}$) and/or a magnitude of switched-hot voltage at a switched-hot terminal SH. At 314, the control circuit may determine if the relay is open based on the magnitude of the switched-hot detect signal $V_{D\text{-}SH}$. If the control circuit determines that the relay is open at 314, the command procedure 300 may exit. However, if the control circuit determines that the relay is stuck closed at 314, then the control circuit may determine whether the variable n is equal to a maximum number $N_{MAX}$ (e.g., five) at 316. If the control circuit determines that the variable n is not equal to the maximum number $N_{MAX}$ at 316, the control circuit may increment the variable n at 318. The control circuit may then control the drive voltage $V_{DR}$ to close the relay during a first line cycle at 320 and control the drive voltage $V_{DR}$ to open the relay during a second subsequent line cycle (e.g., immediately ensuing line cycle) at 308. For example, the control circuit may attempt to close the relay at 320 by driving a SET coil of a non-latching relay or by pulsing a SET coil of a latching relay. Additionally or alternatively, the control circuit may pulse the SET coil of a latching relay a predetermined number of times at 320 to attempt to open the relay.

After attempting to close and open the relay at 320 and 308, the control circuit may then once again wait for the first delay time period $T_{DELAY1}$ at 310, monitor the switched-hot detect signal $V_{D\text{-}SH}$ at 312, and determine whether the relay is stuck closed at 314. If the control circuit determines that the relay remains stuck closed at 314 and determines that the variable n has increased to the maximum number $N_{MAX}$ at 316, the control circuit may determine if the variable m is equal to a maximum number $M_{MAX}$ (e.g., three) at 322. If the control circuit determines that the variable m is not equal to the maximum number $M_{MAX}$ at 322, the control circuit may increment the variable m at 324 and wait for a second delay time period $T_{DELAY2}$ (e.g., two seconds) at 326. The second delay time period $T_{DELAY2}$ may be determined such that the power supply may recharge and/or prevent from overheating. The control circuit may then set the variable n equal to zero at 306 and once again repeatedly attempt to open the relay the maximum number of times (i.e., $N_{MAX}$) at 308-320. If the control circuit determines that the variable m has increased to the maximum number $M_{MAX}$ at 324, the control circuit may mark the relay as stuck closed (e.g., in memory) at 328 and the command procedure 300 may exit. If the control circuit determines that the relay is open at 314 after any of the attempts to close and open the relay, the command procedure 300 may exit at that time without marking the relay as stuck closed.

Figure 3B:
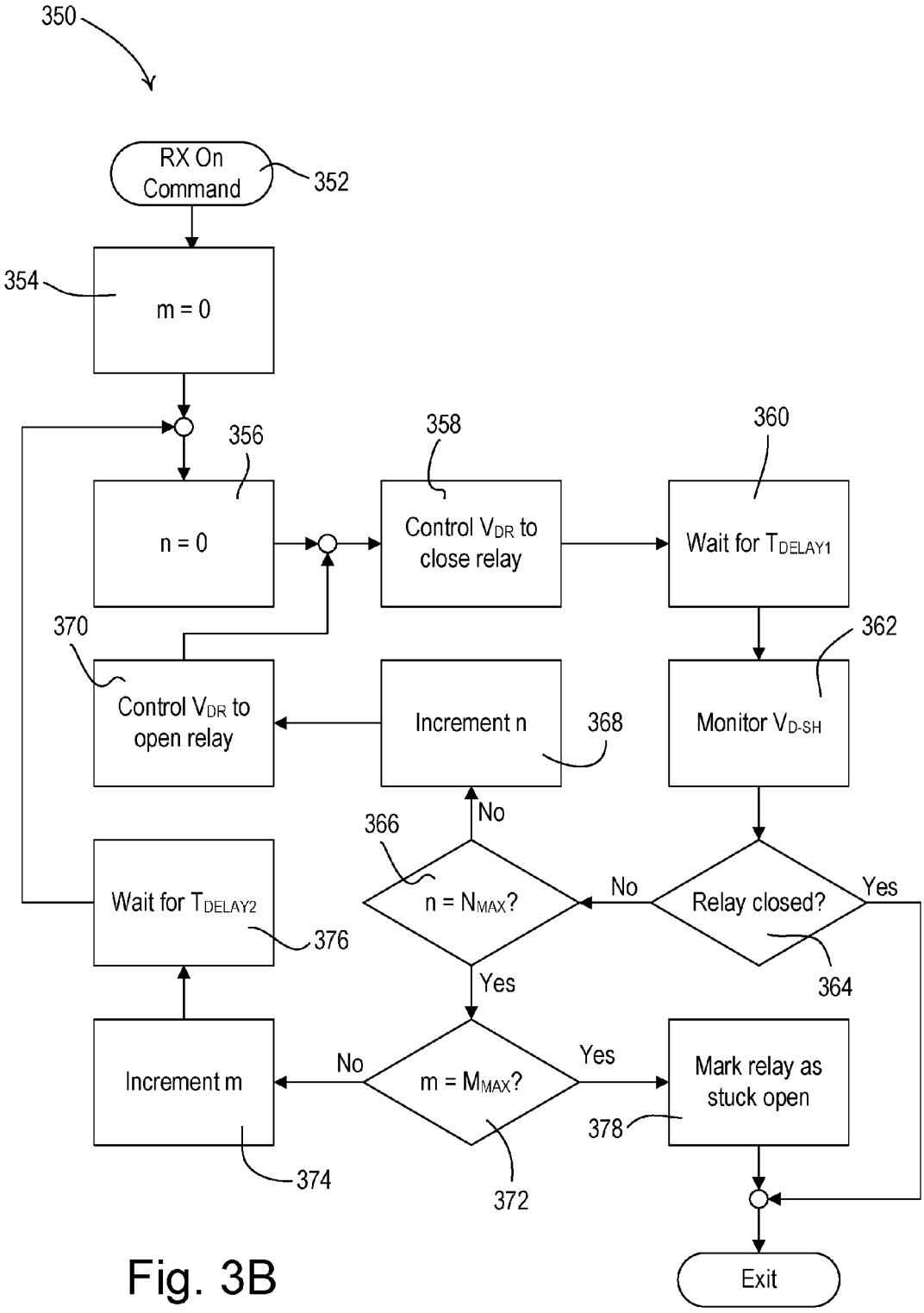
FIG. 3B is a flowchart of another example command procedure for closing a relay.

FIG. 3B is a flowchart of another example command procedure 350 for closing a relay. The command procedure 350 may be executed by a control circuit of a load control device (e.g., the control circuit 112 of the load control device 100) in response to receiving an on command at step 352 (e.g., via the user interface 114 and/or the communication circuit 116). During the command procedure 350, the control circuit may determine if the relay has closed successfully, and may attempt to open and then close the relay if the relay is determined to be stuck open. The control circuit may use two variables m, n during the command procedure 350 to keep track of how many times the control circuit has tried closing and opening the switch (e.g., performed the relay stuck open procedure) after determining that the relay is stuck open.

The control circuit may receive an on command at 352. The control circuit may initialize the variable m to zero at 354 and initialize the variable n to zero at 356. The control circuit may then control the drive voltage $V_{DR}$ to close the relay at 358, for example, by driving a SET coil of a non-latching relay or by pulsing a SET coil of a latching relay. The control circuit may wait at 360 for a first delay time period $T_{DELAY1}$, which for example, may correspond to the total turn-on delay of the relay and electrical hardware driving the relay (e.g., approximately 15 milliseconds).

At 362, the control circuit may monitor (e.g., sample) a switched-hot detect signal (e.g., the switched-hot detect signal $V_{D\text{-}SH}$) and/or a magnitude of switched-hot voltage at a switched-hot terminal SH. At 364 the control circuit may determine if the relay is closed based on the switched-hot detect signal $V_{D\text{-}SH}$. If the control circuit determines that the relay is closed at 364, the command procedure 350 may exit. However, if the control circuit determines that the relay is stuck open at 364, then the control circuit may determine whether the variable n is equal to a maximum number $N_{MAX}$ (e.g., five) at 366. If the control circuit determines that the variable n is not equal to the maximum number $N_{MAX}$ at 366, the control circuit may increment the variable n at 368. The control circuit may then control the drive voltage $V_{DR}$ to open the relay during a first line cycle at 370 and control the drive voltage $V_{DR}$ to close the relay during a second subsequent line cycle (e.g., immediately ensuing line cycle) at 358. For example, the control circuit may attempt to open the relay at 370 by ceasing to driving a SET coil of a non-latching relay or by pulsing a RESET coil of a latching relay. Additionally or alternatively, the control circuit may pulse the RESET coil of a latching relay a predetermined number of times at 370 to attempt to open the relay.

After attempting the open and close the relay at 370 and 358, the control circuit may then once again wait for the first delay time period $T_{DELAY1}$ at 360, monitor the switched-hot detect signal $V_{D\text{-}SH}$ at 362, and determine whether the relay is stuck open at 364. If the control circuit determines that the relay remains stuck open at 364 and determines that the variable n has increased to the maximum number $N_{MAX}$ at 366, the control circuit may determine if the variable m is equal to a maximum number $M_{MAX}$ (e.g., three) at 372. If the control circuit determines that the variable m is not equal to the maximum number $M_{MAX}$ at 372, the control circuit may increment the variable m at 374 and wait for a second delay time period $T_{DELAY2}$ (e.g., two seconds) at 376. The second delay time period $T_{DELAY2}$ may be determined such that the power supply may recharge and/or prevent from overheating. The control circuit may then set the variable n equal to zero at 356 and once again repeatedly attempt to close the relay the maximum number of times (i.e., $N_{MAX}$) at 358-370. If the control circuit determines that the variable m has increased to the maximum number $M_{MAX}$ at 374, the control circuit may mark the relay as stuck open (e.g., in memory) at 378 and the command procedure 350 may exit. If the control circuit determines that the relay is closed at 364 after any of the attempts to open and close the relay, the command procedure 350 may exit at that time without marking the relay as stuck closed.

What is claimed is:

1. A load control device for controlling power delivered from an AC power source to an electrical device, the load control device comprising:

a first electrical connection adapted to be electrically coupled to the AC power source;

a second electrical connection adapted to be electrically coupled to the electrical device;

a relay electrically coupled between the first and second electrical connections and configured to control the power delivered from the AC power source to the electrical device so as to generate a switched-hot voltage at the second electrical connection;

a detect circuit electrically coupled to the second electrical connection and configured to generate a detect signal indicating a magnitude of the switched-hot voltage;

a control circuit configured to generate a drive signal for attempting to open and close the relay, configured to monitor the detect signal, and configured to determine whether the relay is open or closed based on the detect signal;

wherein the control circuit is further configured to perform a stuck closed procedure in response to determining that the relay is stuck closed, the stuck closed procedure comprising the control circuit attempting to close the relay, attempting to open the relay, monitoring the detect signal, and determining whether the relay is stuck closed.

2. The load control device of claim 1, wherein the control circuit is configured to repeatedly perform the stuck closed procedure until the control circuit determines that the relay is open based on the detect signal or until the control circuit performs the stuck closed procedure a first maximum number of times.

3. The load control device of claim 2, further comprising:

a memory coupled to the control circuit;

wherein, if the control circuit performs the stuck closed procedure the first maximum number of times, the control circuit is configured to wait a predetermined amount of time or mark the relay as stuck closed in the memory.

4. The load control device of claim 3, wherein, if the control circuit waits the predetermined amount of time, the control circuit is configured to repeatedly perform the stuck closed procedure until the control circuit determines that the relay is open based on the detect signal or until the control circuit performs the stuck closed procedure the first maximum number of times.

5. The load control device of claim 4, wherein, if the control circuit performs the stuck closed procedure the first maximum number of times for a second maximum number of cycles, the control circuit is configured to mark the relay as stuck closed in the memory.

6. The load control device of claim 3, wherein, after marking the relay as stuck closed in the memory, the control circuit is configured to perform the stuck closed procedure at least one additional time.

7. The load control device of claim 1, wherein the control circuit is configured to receive a command to open the relay.

8. The load control device of claim 7, wherein, in response to receiving the command to open the relay, the control circuit is configured to control the drive signal to open the relay and to subsequently wait for a predetermined amount of time before monitoring the detect signal to determine if the relay is stuck closed.

9. The load control device of claim 7, further comprising:

an actuator configured to receive a user input;

wherein the control circuit is configured to receive the command to open the relay via the actuator.

10. The load control device of claim 7, further comprising:

a communication circuit configured to receive a digital message;

wherein the control circuit is configured to receive the command to open the relay via the digital message.

11. The load control device of claim 1, further comprising:

a visual indicator configured to be illuminated to provide feedback to a user;

wherein the control circuit is configured to illuminate the visual indicator in response to determining that the relay is stuck closed.

12. The load control device of claim 11, wherein the control circuit is configured to blink the visual indicator in response to determining that the relay is stuck closed.

13. The load control device of claim 1, wherein the relay comprises a latching relay.

14. The load control device of claim 13, wherein the control circuit is configured to pulse a SET coil of the latching relay in response to determining that the relay is stuck closed.

15. The load control device of claim 1, wherein the relay comprises a non-latching relay.

16. The load control device of claim 1, wherein the stuck closed procedure further comprises the control circuit waiting a predetermined amount of time after attempting to open the relay and before monitoring the detect signal.

17. The load control device of claim 1, further comprising:

a communication circuit configured to transmit a digital message in response to determining that the relay is stuck closed.

18. The load control device of claim 1, further comprising:

a memory coupled to the control circuit;

wherein the control circuit is configured to mark the relay as stuck closed in the memory in response to determining that the relay is stuck closed.

19. The load control device of claim 1, wherein the detect circuit comprises a zero-cross detect circuit.

20. The load control device of claim 1, wherein the electrical device comprises a lighting load.

21. A method for controlling power delivered from an AC power source to an electrical device using a load control device, the method comprising:

generating a detect signal indicating a magnitude of a switched-hot voltage;

generating a drive signal for attempting to open and close a relay;

monitoring the detect signal;

determining whether the relay is open or closed based on the detect signal; and performing a stuck closed procedure in response to determining that the relay is stuck closed, the stuck closed procedure comprising attempting to close the relay, attempting to open the relay, monitoring the detect signal, and determining whether the relay is stuck closed.

22. The method of claim 21, further comprising:

repeatedly performing the stuck closed procedure until it is determined that the relay is open based on the detect signal or until the stuck closed procedure is performed a first maximum number of times.

23. The method of claim 22, wherein, if the stuck closed procedure is performed the first maximum number of times, the method further comprises:

waiting a predetermined amount of time or marking the relay as stuck closed in memory.

24. The method of claim 21, further comprising:

receiving a command to open the relay; and in response to receiving the command to open the relay, controlling the drive signal to open the relay and subsequently waiting for a predetermined amount of time before monitoring the detect signal to determine if the relay is stuck closed.

25. The method of claim 21, further comprising:

receiving a command to open the relay in response to an actuation of an actuator.

26. The method of claim 21, further comprising:

receiving a digital message via a communication circuit; and receiving a command to open the relay via the digital message.

27. The method of claim 21, further comprising:

illuminating a visual indicator to provide feedback to a user in response to determining that the relay is stuck closed.

28. The method of claim 21, further comprising:

waiting a predetermined amount of time after attempting to open the relay and before monitoring the detect signal.

29. The method of claim 21, further comprising:

transmitting a digital message via a communication circuit in response to determining that the relay is stuck closed.

30. The method of claim 21, further comprising:

marking the relay as stuck closed in memory in response to determining that the relay is stuck closed.

31. A load control device for controlling power delivered from an AC power source to an electrical device, the load control device comprising:

a first electrical connection adapted to be electrically coupled to the AC power source;

a second electrical connection adapted to be electrically coupled to the electrical device;

a relay electrically coupled between the first and second electrical connections and configured to control the power delivered from the AC power source to the electrical device so as to generate a switched-hot voltage at the second electrical connection;

a detect circuit electrically coupled to the second electrical connection and configured to generate a detect signal indicating a magnitude of the switched-hot voltage;

a control circuit configured to generate drive signals to attempt to open and close the relay, wherein the control circuit is further configured to:

attempt to open the relay;

monitor the detect signal;

determine that the relay is stuck closed based on the detect signal; and in response to determining that the relay is stuck closed, attempt to close the relay and then attempt to open the relay.

* * * * *